United States Patent [19]

Coerstges et al.

[11] Patent Number: 4,734,958

[45] Date of Patent: Apr. 5, 1988

[54] DRAFTING FRAME FOR A SPINNING MACHINE

[75] Inventors: Josef Coerstges, Uhingen; Bernhard Zimmerman, Ebersbach, both of Fed. Rep. of Germany

[73] Assignee: Zinser Textilmaschinen GmbH, Ebersbach, Fed. Rep. of Germany

[21] Appl. No.: 935,766

[22] Filed: Nov. 28, 1986

[30] Foreign Application Priority Data

Nov. 29, 1985 [DE] Fed. Rep. of Germany ..... 3542355

[51] Int. Cl.[4] ..... D01H 5/70

[52] U.S. Cl. ..... 19/258; 19/261; 19/266; 19/284

[58] Field of Search ..... 19/258, 261, 266, 269, 19/284, 285, 278

[56] References Cited

U.S. PATENT DOCUMENTS 1,186,066 6/1916 Bache ..... 19/284 X 2,890,495 6/1959 Miesch et al. ..... 19/261

4,413,378 11/1983 Miandl et al. ..... 19/258

4,551,887 11/1985 Uematsu ..... 19/266 X

FOREIGN PATENT DOCUMENTS 1875935 5/1961 Fed. Rep. of Germany .

*Primary Examiner*—Louis K. Rimrodt

*Attorney, Agent, or Firm*—Karl F. Ross; Herbert Dubno

[57] ABSTRACT

The invention is a drafting frame of a spinning or twisting machine comprising a plurality of roll pairs or roll triads comprising upper and lower rolls, the upper rolls being guided at their ends by bearings in at least one supporting arm rotatable about a pivot shaft with the spacing of the upper rolls from each other being changeable. Each of the bearings is a guide means, advantageously an open ended slot, aligned with an axis of a lower roll. Every supporting arm has at least two guide means spaced from each other for at least one of the upper rolls.

7 Claims, 4 Drawing Sheets

DRAFTING FRAME FOR A SPINNING MACHINE

FIELD OF THE INVENTION

My present invention relates to a drafting or drawing frame for a spinning machine and, more particularly, to the swingable upper arm carrying drafting or drawing rolls and associated with the drafting or drawing frame.

BACKGROUND OF THE INVENTION

A drafting frame can comprise a plurality of drafting roll pairs or triads comprising upper and lower drafting rolls, the ends of the upper drafting rolls being journaled via bearings on a supporting arm pivotable about a pivot shaft with the spacing of the upper rolls from each other being variable.

This variability is described in German Utility Model DE-GM 1 875 935. The pivot shaft is rotatable to provide a stepless fine adjustment of the spacing of the feed roll pair results. For rotation a worm drive is provided. This arrangement is expensive to build since an additional drive for rotation of the pivot lever must be used to attain a change in the spacing of the two feed rolls.

OBJECTS OF THE INVENTION

It is an object of my invention to provide an improved drafting frame for a spinning or twisting machine which affords simple adjustability of the spacing of the roller nips at low cost.

It is also an object of my invention to provide an improved drafting frame for a spinning or twisting machine in which it is easy to change the spacing of the clamping lines or nip positions of the roll pairs with respect to each other.

SUMMARY OF THE INVENTION

These objects and others which will become more readily apparent hereinafter are attained in accordance with my invention in a drafting frame or drawing frame for a spinning or twisting machine comprising a plurality of roll pairs or roll triads including a plurality of upper and lower rolls, the ends of the upper rolls being guided by bearings in at least one supporting arm pivotable about a pivot shaft with the spacing of the upper rolls from each other being changeable.

According to my invention each of the bearings in the supporting arm is a guide means aligned with an axis of a lower roll and the supporting arm has at least two of the guide means spaced from each other for at least one of the upper rolls.

The structure provided by my invention has the advantage there guide means afford a well defined, accurate and adjustable positioning of the roller nips in a given machine and with a high degree of reproducibility in a variety of machines. A well thought out arrangement of the guide means in consideration of the diameter and spacing of the lower rolls and the sliver length of the fiber material to be worked permits a limited number of guide means for each roll combination to fulfill all technical requirements with the clamping line or nip spacing as desired. The different arrangements of these guide means are clearly distinguishable so that erroneous adjustments can be prevented.

The guiding means can be a slot, groove, strip or similar element. It is possible to simply and quickly shift each upper roll to a guide means at a different place.

Without my invention measuring tools for determining the correct spacing are required.

Advantageously a plurality of guide means are provided for each of the upper rolls as bearings in the supporting arm. Also each of the guide means can be a slot open at one end. In the guide means a plurality of pressing elements loading the upper rolls can be provided. The upper rolls are guidable by a plurality of pressing elements.

In one embodiment of my invention at least one of the pressing elements has a plurality of guide elements displaced laterally in the guiding direction of the associated upper roll by means of which the pressing element is usable in two different positions to hold the upper rolls in place.

In another embodiment of a drafting frame according to my invention in which there is a common supporting arm for all of the upper rolls mounted on one side thereof, the common supporting arm contains all of the guide means for the upper rolls. The common supporting arm comprises two parallel plates which contain the guide means, a supporting element being positioned between the plates for each of the upper rolls. The supporting element comprises a pressing element guided in the plates which has a sleeve in which a shaft which acts on the pressing element is arranged to act on an axis of the upper roll. This shaft can be provided with a ring engaging a shaft of the upper roll.

In another embodiment of a drafting frame according to my invention with at least three lower rolls and at least three upper rolls, the supporting arm has one slot aligned with an axis of an outlet lower roll which together with an associated outlet one of the upper rolls defines a first clamping line and the supporting arm has one additional slot for guiding a middle one and another additional slot for guiding a rear one of the upper rolls which are suitably aligned with the middle and the rear lower roll to provide other mounting positions.

In an additional embodiment of a drafting frame according to my invention with at least three lower rolls and at least three upper rolls, the supporting arm has one of the slots aligned with an axis of an outlet lower roll which defines together with the associated outlet upper roll a first clamping line and the supporting arm has an additional slot aligned with the middle lower roll for an additional upper roll between the front and the middle upper roll.

In another embodiment of a drafting frame according to my invention with at least three lower rolls and at least three upper rolls, the supporting arm has one of the slots aligned with an axis of an outlet lower roll which together with an associated outlet upper roll defines a first clamping line and the supporting arm has one additional slot for guiding a middle one and another additional slot for guiding a rear upper roll which are suitably aligned with the middle and rear one of the lower rolls to provide another mounting position.

In another embodiment of a drafting frame according to my invention with at least three lower rolls and at least three upper rolls, the supporting arm has one of the slots aligned with an axis of an outlet one of the lower rolls which define together with the associated outlet upper roll a first clamping line and the supporting arm has an additional one of the slots aligned with the middle lower rolls for an additional upper roll between the front and the middle upper roll.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
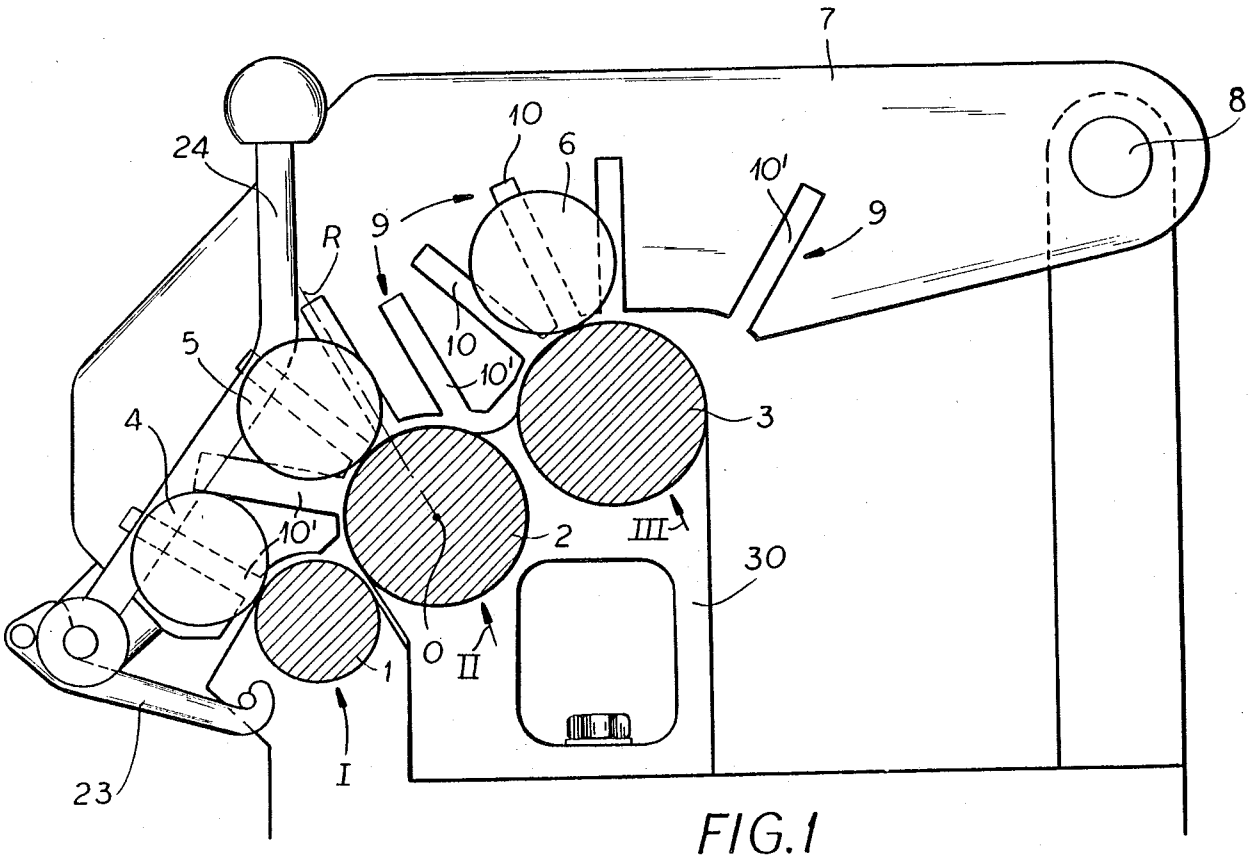
FIG. 1 is a schematic side elevational view of a drafting frame of a spinning or twisting machine according to my invention with lower rolls shown in cross section in the operating position.

According to FIG. 1 a drafting frame of a spinning or twisting machine has three feed roll pairs I, II and III. The lower rolls 1, 2, 3 work together with the associated upper rolls 4, 5, 6. These upper rolls 4, 5, 6 are supported at their ends on bearings in a supporting arm 7. The bearings in the supporting arm 7 comprise guide means 9 each directed an the axis of the corresponding lower rolls 1, 2, 3.

Each supporting arm 7 has at least two guide means 9 spaced from each other for at least one of the upper rolls 4, 5, 6. In the structure according to FIG. 1 the guide means 9 is a slot 10 open at one end.

The supporting arm 7 is pivotable about a pivot shaft 8 and can be secured in the operating position by a catch 23. This catch 23 may be operated by a handle 24, i.e. when the supporting arm 7 is to be disengaged from the operating position and then pivoted into an opened position.

As seen from FIG. 1 the guide means 9 in the supporting arm 7 are open slots 10 directed toward the lower rolls 1, 2, 3. Thus at least one part of the slot 10 lies on a radius R extending from the midpoint 0 of the associated lower roll. As is apparent one and/or two and/or three slots 10 are provided for every upper roll 4,5,6. Because of that a sufficient variability in regard to the desired clamping line spacing (spacing between the clamping lines or nips C) suitability for the different materials to be worked is attained.

Different setups are shown in FIGS. 2 to 6. Also there is a possibility shown in FIG. 1 that both lower rolls 2 and 3 are mounted in a carriage 30 which is slidable in a horizontal plane. In the shoved back position of the carriage 30 the slot 10′ is associated with the lower rolls 3 and/or 2.

Figure 2:
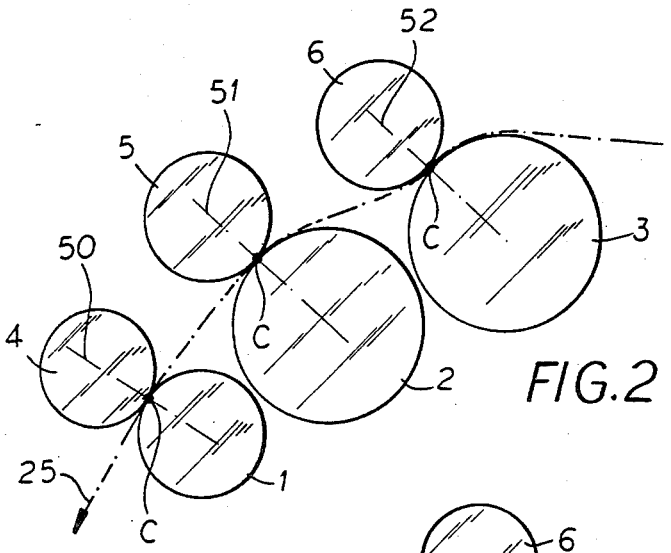
FIGS. 2 to 6 are cross sectional views showing different possible arrangements for the drafting rolls.

According to FIG. 2 the outlet roll 4 is put in the first slot, a first clamping plane 50 being formed between it and the associated lower roll 1. The middle upper roll 5 is put in the corresponding middle slot 10 of the supporting arm 7; the lower upper roll 6 is supported in the corresponding front slot 10 of the supporting arm 7 and works together with the rear lower roll 3. These rolls form clamping planes 51 and 52.

Figure 3:
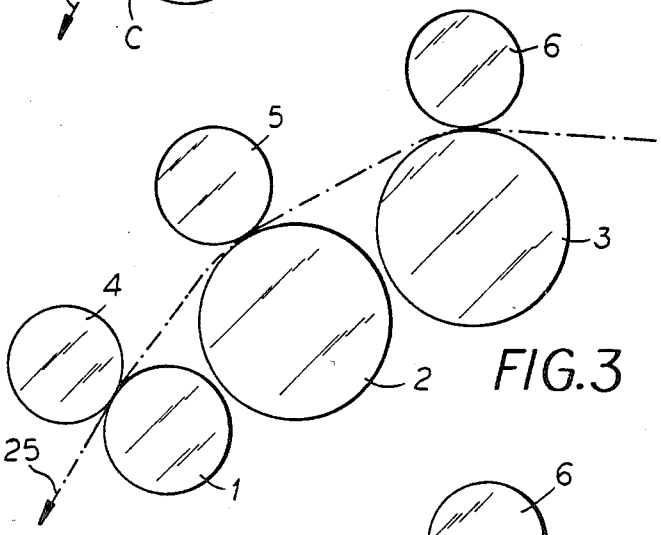

In the arrangement of to FIG. 3 the lower and upper rolls 1 and 4 and/or 2 and 5 are arranged in the position according to FIG. 2; only the rear upper roll 6 is located in the rear slot 10 of the supporting arm 7.

Figure 4:
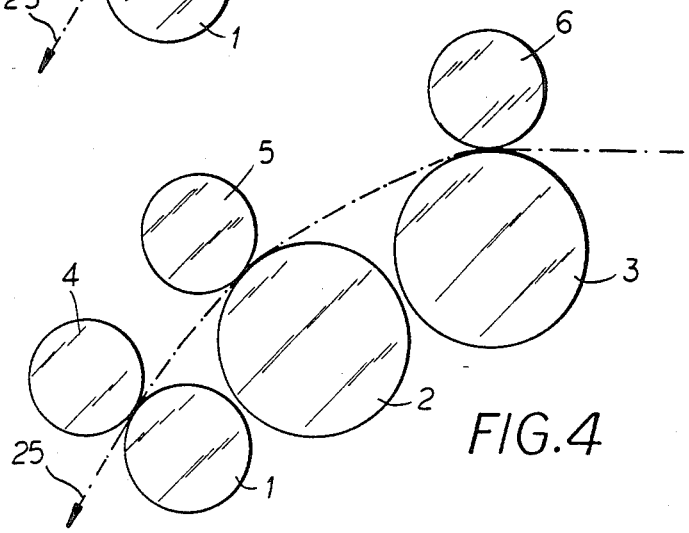

In the arrangement of to FIG. 4 the central or middle upper roll 5 is put in the corresponding front slot 10 of the supporting arm 7. The upper and/or lower rolls 4 and 1 and/or 6 and 3 remain in the position shown in FIG. 3.

Figure 5:
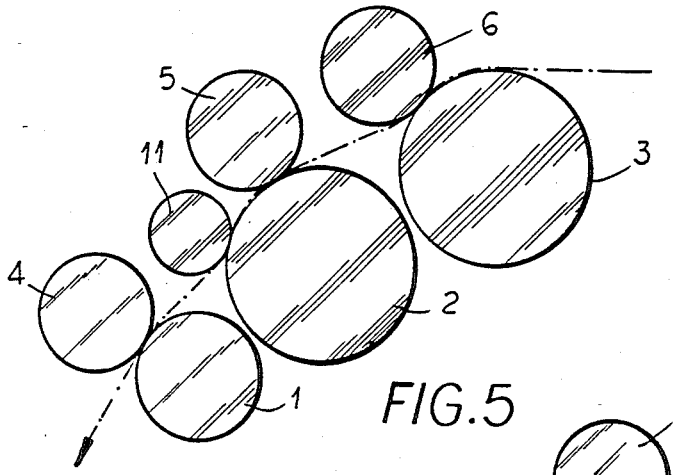

In the arrangement of FIG. 5 an additional upper roll 11 is used which is put in the corresponding front slot with reference to the middle lower roll 2. The rear upper roll 6 is put in the corresponding front slot of the supporting arm 7.

Figure 6:
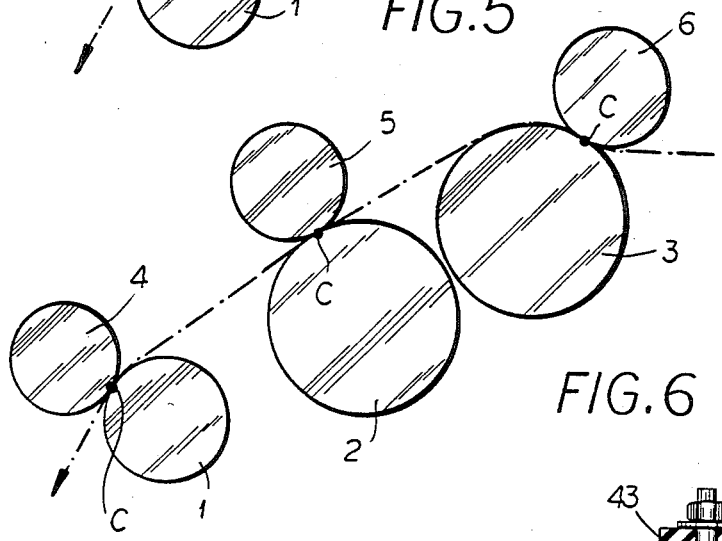
Figure 7:
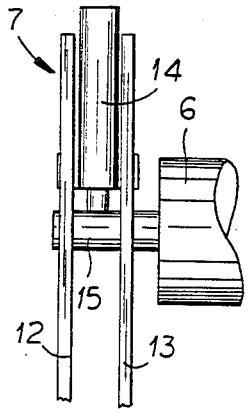
FIG. 7 is a partially cutaway front elevational view of a supporting arm in the drafting frame according to my invention.

In the arrangement of to FIG. 6 the carriage 30 shown in FIG. 1 is pushed to the right so that between the outlet lower roll 1 and both the additional lower rolls 2 and 3 a considerable spacing results. It is also possible to arrange the middle upper roll 5 in one of the slot 10 and/or 10′ and the rear upper roll 6 likewise in a slot 10 and/or 10′ designed for it.

It is apparent that as a result of the slots a large number of possible variations exist for different arrangements of the slots so that the clamping lines can be changed according to the material to be worked.

From FIGS. 1, 7, 8 and 11 it is seen that every supporting arm 7 comprises two parallel plates 12 and 13 at each end of each upper roller, e.g. the roller 6. Between these plates 12 and 13 respectively a sleeve 14 is positioned which is formed with plane surfaces which cooperate with the plates 12 and 13.

A shaft 16 with a flange 18 fits into each hollow of the respective sleeve 14. This flange 18 is acted on by a compressible spring 17 which is braced at one end on the flange 18 and at the other end on the upper wall of the receptacle inside the sleeve 14. The shaft 16 in this case acts on the axis 15 of the upper roll 6 with its front end 26. Because of that the upper roll 6 is pressed toward the associated lower roll; the members 14, 16 and 17 form pressing elements which load the corresponding upper roll whereby the upper rolls 4, 5, and 6 are guided by these pressing elements 14, 16 and 17. Removable pins 44 prevent the sleeves 14 from dropping out.

Figure 9:
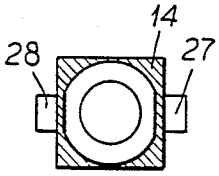
FIGS. 9 to 10 are partially top plan, partially cross sectional views of two forms of a pressing element used in my invention.
Figure 8:
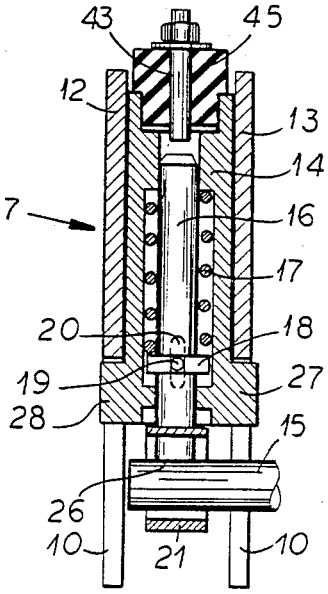
FIG. 8 is a cross sectional view through the upper portion of one side of a supporting arm, partially cutaway.

The sleeve 14 is provided with guide elements 27 and 28 according to FIGS. 8 and 9 which are guided in the grooves 10 in the parallel plates 12 and 13. Thus the sleeve 14 travels to a satisfactory position in both plates 12 and 13 of the pivotable lever.

The shaft 15 of the upper roll 6 is surrounded by a ring 21 whose upper portion is mounted in a groove 20 of shaft 16. This ring 21 acts moreover to move the supporting arm 7 from the operating position into an open position to take the axis 15 of the related upper roll with it so that on disengaging all upper rolls are separated from the lower rolls.

In the upper region the sleeve 14 has a contact pin 43 in an insulating sleeve 45, i.e. to ground the latter which acts, for example upon winding of roving, on the upper roll and the pressing of pin 16 is upward to make electric contact with pin 43, to trigger a circuit which stops the machine.

The shaft 16 has a second pin 19 in its lower region which rides in an elongated hole 20 of the sleeve 14 to limit the stroke of the pin 16 and prevent rotation of it.

In the embodiment according to FIGS. 8 and 9 the guide elements 27 and 28 are symmetrical with respect to the central axis of the sleeve 14. It is also possible as shown in FIGS. 10 and 11 to position the guide elements 27' and 28' asymmetrically.

Figure 10:
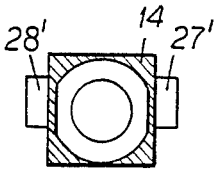
Figure 11:
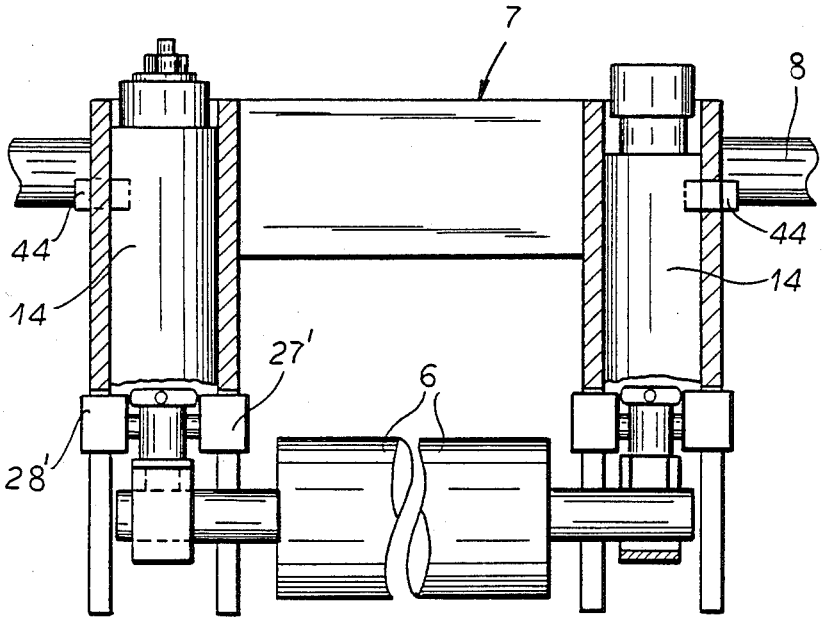
FIG. 11 shows how each upper rolls is supported between two arm parts.

Thus for the asymmetric case two operating positions result each according to whether the elements of the sleeve 14 in the position shown in the FIG. 10 or are displaced about 180° are positioned in the slots 10 in the plates 12 and 13. In a simple way then two different positions in regard to the action of the pressing elements 14,16 and 17 on the corresponding upper rolls results.

By the slots 10 in the supporting arm 7 which act as bearings for the upper rolls 4,5,6 and/or 11 the advantage of a larger variation in regard to the spacing of the clamping lines from each other results so that fibers or yarn of very different sliver length can be worked and suitable required changes can be easily performed. The spacing between the first roll pair I and the second roll pair II in regard to its clamping length amounts to between 40 mm and 84 mm in a suitable structure. The spacing between the clamping line of the second roll pair II and the third roll pair III can amount to between 55 mm and 96 mm in a suitable situation. Thus a very large width variation results.

With cotton and synthetic fibers of rayon with cotton of a length up to 40 mm the spacing of the clamping line between the roll pairs 1,4 and 2,11 should be to about 40 mm and/or 44 mm. The clamping line spacing between the roll pair 2,5 and 3,6 should be about 56 mm.

By putting the upper roll 5 in another slot 10 the clamping line spacing between roll pairs 1,4 and 2,5 for synthetic rayon with larger sliver length is increased to about 58 and/or 65 mm.

Correspondingly the clamping line spacing between the roll pairs 2,5 and 3,6 must be increased to about 65 and/or to about 78 mm by putting the upper roll 6 in another slot.

By sliding the carriage 30 about 30 mm to the rear and putting in the upper roll 5 and/or 6 in a corresponding slot the clamping line spacing for synthetic rayon fibers increases to about 85 mm and/or about 93 mm.

The pressing elements 14,16,17 can clearly be also thought of as supporting elements for the upper rolls.

I claim:

1. A drafting mechanism for a spinning machine comprising:

a drafting frame having a support;

a shaft mounted on said support and defining a pivot axis;

a carriage on said frame below said arm;

three lower drafting rollers rotatable about respective axes of rotation, defining respectively an outlet, inlet and an intermediary lower rollers, said intermediary and inlet rollers being mounted on said carriage and shiftable therewith horizontally perpendicular to said axis of rotation;

a plurality of slots formed in said arm, two of said slots extending radially to each of said intermediary and inlet lower rollers, said slots opening toward said lower rollers, said output lower roller being fixedly arranged and aligned with respective one of said slots; and respective upper rollers each paired with one of said lower rollers and carried on said arm so as to be swingable therewith about said pivot axis away from said lower rollers, said upper rollers being adapted to clamp a roving passing through said frame against said lower rollers along respective clamping lines at respective nips of the rollers of each pair, said upper roller paired with said intermediary and inlet lower rollers being selectively positionable in a respective one of each of said two slots extended radially of the respective roller so as to enable selection of a particular spacing of said clamping lines from one another.

2. The drafting mechanism defined in claim 1 wherein said support arm has a further one of said slots aligned with said axis of rotation of said outlet lower roller which together with an outlet one of said upper rollers defines a first one of said clamping lines, said arm having two of slots alinged with said axis of said intermediary rollers, which are so arranged that a middle one of said upper roller put into its respective slot defines one of two additional ones of said clamping lines, of which one has a spacing of 52 mm to 58 mm and the other a spacing of 63 mm to 79 mm from said first clamping line.

3. The drafting mechanism defined in claim 1 wherein said support arm has a further one of said slots aligned with said axis of rotation of said outlet lower rollers which together with an outlet one of said upper rolls defines a first said clamping lines and said arm has one additional slot for guiding a middle one of said upper rollers and an additional slot for guiding an inlet one of said upper rollers which are radially aligned with said intermediary and said inlet lower rollers to provide additional mounting positions.

4. The drafting mechanism defined in claim 1 wherein said arm has one of said slots aligned with the axis of an outlet one of said lower rollers which defines together with a respective one of said upper rollers a first of said clamping lines and said arm has an additional slot aligned with the intermediary lower roller for an additional one of said upper rollers between the outlet upper roller and a middle one of said upper rollers.

5. A drafting mechanism for a spinning machine, comprising:

a drafting frame having a support;

a shaft mounted on said support and defining a pivot axis;

at least one support arm mounted on said shaft and swingable about said axis, said arm being formed with a pair of parallel plates, each of said plates having a plurality of downwardly open slots registering with the slots of the other plate;

a plurality of lower rollers defining an inlet, outlet and intermediary rollers below said arm on said frame and positioned so that said slots of said plate extend in pairs radially to said lower rollers and open toward said lower rollers, each pair of said slots being radially aligned with respective axes of rotation of the respective lower rollers;

respective upper rollers adapted to clamp a roving passing through said frame against said lower rollers along respective clamping lines at respective nips of the rollers of each pair;

respective means for guiding each of said upper rollers on said arm, said means for guiding including:

a roller journaling sleeve having an axis and formed with planar surfaces, said sleeve being located between said plates and guided in a respective pair of said slots, a rod located along said sleeve axis and movable back and forth along said sleeve axis, and two guide elements received in said slots and formed on one end of said sleeve, said elements being mutually offset from said sleeve axis so that two different clamping lines at respective nips of the rollers of each pair result.

6. The drafting mechanism defined in claim 5 further comprising an insulating sleeve connected to a respective one of said roller-journaling sleeves and having a contact pin extending into an upper region of the respective roller-journaling sleeve, said pin being engaged by said rod and forming part of a circuit for stopping said machine.

7. A drafting machanism for a spinning machine, comprising:

a support;

a plurality of spaced apart, mutually parallel lower rollers mounted on said support for rotation about respective horizontal axes and including an inlet roller, an intermediary roller and an outlet roller;

an arm swingable on said support about a horizontal axis and extending above said lower rollers, said arm being formed with at least two angularly inclined slots opening downwardly toward each of said inlet and intermediary lower rollers and elongated radially away from open ends of said slots while lying along respective radii of the axes of said inlet and intermediary lower rollers;

an inlet upper roller forming a nip with said inlet lower roller along a first clamping line, an intermediary upper roller forming a nip with said intermediary lower roller along a second clamping line, and an outlet upper roller forming a nip with said outlet lower roller along a third clamping line, said upper rollers being mounted on said arm; and means for selectively positioning each of said inlet and intermediary upper rollers respectively in one of the pair of slots aligned radially with the axis of the corresponding lower roller and for enabling radial shifting of said upper rollers in the respective slots, whereby the spacing of said clamping lines for a roving passing between said upper and said lower rollers from said inlet rollers to said outlet roller can be varied on said arm solely by selection of the slots in which said upper inlet and intermediary rollers are mounted.

* * * * *